US005172657A

United States Patent [19]

Sausner et al.

[11] Patent Number: 5,172,657

[45] Date of Patent: Dec. 22, 1992

[54] EVAPORATION COOLED INTERNAL COMBUSTION ENGINE

[75] Inventors: Andreas Sausner, Frankfurt am Main; Klaus Mertens, Hemsbach; Hans-Peter Jaekel, Frellstedt, all of Fed. Rep. of Germany

[73] Assignee: Firma Carl Freudenberg, Weinheim, Fed. Rep. of Germany

[21] Appl. No.: 798,555

[22] Filed: Nov. 26, 1991

[30] Foreign Application Priority Data

Nov. 27, 1990 [DE] Fed. Rep. of Germany ..... 4037644

[51] Int. Cl.[5] ..... F01P 9/02

[52] U.S. Cl. ..... 123/41.21; 123/41.5

[58] Field of Search ..... 123/41.2, 41.21, 41.27, 123/41.5, 41.51

[56] References Cited

U.S. PATENT DOCUMENTS 4,584,971 4/1986 Neitz et al. ..... 123/41.27

4,648,356 3/1987 Hayashi ..... 123/41.21

*Primary Examiner*—Noah P. Kamen

*Attorney, Agent, or Firm*—Kenyon & Kenyon

[57] ABSTRACT

An evaporation-cooled internal combustion engine, in which a cooling system, through which a coolant can flow, and to which pressure can be applied, is connected with an equalization container, where the equalization container is connected to a steam-filled zone of the cooling system by means of a connection line. At least one auxiliary means to reduce the interior pressure in the cooling system is assigned to the equalization container.

12 Claims, 3 Drawing Sheets

EVAPORATION COOLED INTERNAL COMBUSTION ENGINE

BACKGROUND OF THE INVENTION

The invention relates generally to improvements in an evaporation-cooled internal combustion engine, in which a cooling system, through which a coolant can flow, and to which pressure can be applied, is connected with an equalization container. The equalization container is connected to a steam-filled zone of the cooling system by means of a connection line.

The general type of such an internal combustion engine is known from U.S. Pat. No. 4,648,356. According to this reference, the cooling system generally consists of an engine water mantle, a condenser, a condensate tank, and a container. The container is divided into two chambers by a membrane, where the chamber facing away from the cooling system is open towards the atmosphere. As the temperature of the coolant rises, and as the pressure on the side of the membrane facing towards the cooling system to which it is connected increases, the volume of the cooling system is automatically changed. This system temporarily draws air located within the hermetically sealed system out of the system away from the condenser, and so enhances the functioning of the system. The air, which is disadvantageous for the functioning of the system, is stored in the container having the membrane during operation of the internal combustion engine. Once the engine is stopped and has cooled, the air is passed back into the system in order to avoid the creation of a vacuum. Another component of the system is an electrically driven fan, which allows cooling air to flow past the condenser as needed, and thus changes the temperature of the coolant fluid as a function of the flow of cooling air.

In this known device, little external influence can be exerted on the pressure in the cooling system from the outside. Essentially, the spring characteristic and the atmospheric pressure determine the interior pressure within the cooling system and thus the boiling temperature of the coolant connected with it. The operation of the fan (the only component which can be controlled from the outside) results in only a slight and slow change of the temperature of the coolant. To achieve even this slight effect, however, the fan requires a relatively high amount of energy. Because the pressure in the cooling system is not adjustable to a sufficient degree, it is not always possible to properly adjust the boiling temperature of the coolant in response to the operating condition of the internal combustion engine. Due to this limitation, the temperature of the coolant, as well as the temperature of the parts that are in contact with the combustion space, can not be adjusted to an optimum value for an advantageous course of combustion.

The invention is directed to the problem of further developing an internal combustion engine in which the boiling temperature of the coolant can simply and reliably be controlled over a greater range.

SUMMARY OF THE INVENTION

This task is accomplished, according to the invention, with an evaporation-cooled internal combustion engine, in which a cooling system, through which a coolant flows, and to which pressure can be applied, is connected with an equalization container. The equalization container is connected to a steam-filled zone of the cooling system by means of a connection line. At least one auxiliary means to reduce the interior pressure in the cooling system is provided for the equalization container. In the evaporation-cooled internal combustion engine according to the invention, the equalization chamber is provided with at least one auxiliary means to reduce the interior pressure of the coolant within the cooling system.

In evaporation cooling, the boiling temperature of the coolant is a function of the pressure in the cooling system. A low system pressure results in a low coolant boiling temperature. Consequently, the boiling temperature may be reached or exceeded at relatively low coolant temperatures (as is desired in full-load operation) because the system pressure is set low. Such a low setting of the system pressure and the concomitant low boiling point enables evaporation of the coolant to begin at a correspondingly low temperature. Thus, the components of the internal combustion engine are cooled and protected against thermal overload. In partial-load operation, on the other hand, higher system pressures and boiling temperatures are desired in order to operate the internal combustion engine in an optimum component temperature range.

The auxiliary means for adjusting coolant system pressure can consist of a relatively mobile and gas-tight partition arranged in the equalization container, which separates the space containing evaporated coolant from an equalization space. The equalization space is provided with an evacuation device which can be signal-activated. To control the system pressure, it is provided that vacuum be applied to the relatively mobile, gas-tight partition. As a result of the movement of the partition in the equalization container, the entire volume of the cooling system (and therefore the system pressure) is regulated as a function of the operating point of the internal combustion engine. The partition can be moved hydraulically or pneumatically. Direct mechanical activation of the partition, e.g. by means of a servomotor or a magnet, is also possible.

The desired system pressure can be determined, for example, from the following parameters: coolant temperature, component temperature, amount of vacuum in a suction pipe, position of throttle valves, rpm's of the internal combustion engine, fuel injection amount, ambient temperature, and vehicle speed. In the case of electronically controlled internal combustion engines, a large number of the auxiliary values mentioned above are routinely available, so that no additional sensors are required.

The partition can be based on a piston. This enables one to simply allow for large volume changes in the equalization container. Furthermore, as a component, a piston can be produced in a simple manner. The piston must be provided with a seal along its outside circumference in order to maintain the pressure in the cooling system.

The partition can also be an elastic membrane made from a gas-impermeable material. This type of construction is particularly practical for cooling systems that require only relatively small volume changes for adaptation of the system pressure to the operating point of the internal combustion engine in question. Such a system represents a simple and cost-effective solution.

Another possibility is for the partition to be supported on a pressure spring arranged in the equalization space. The spring can be provided as a screw pressure spring, a plate spring package, or as a foam element of elastomer material, for example. The equalization space containing the spring is preferably isolated from the coolant so that the latter cannot chemically attack the spring.

The evacuation device may consist of a line connecting the equalization space with the suction system of the internal combustion engine. The line may be selectively closed off by at least one valve. In this embodiment, a suction system must be present for providing a vacuum sufficient to activate the partition. This embodiment is an especially cost-effective way of moving the partition and thereby altering the volume of the coolant system.

The evacuation device may also include a line connecting the equalization space with the suction system of the internal combustion engine, to which a vacuum tank has been assigned. Especially in full-load operation of the internal combustion engine, relying on a vacuum from the suction pipe to the partition in the equalization container may be troublesome. When the throttle valves are fully open, only an insufficient vacuum may be available to shift the partition against the counterbalancing spring force. If a vacuum tank containing a kick-back valve that can be opened in the direction of the suction system is arranged in the line, proper operation of the cooling system is ensured even in full-load operation, when the throttle valves are fully opened. In idle or partial load operation, when sufficient vacuum is available for displacement of the partition, but is not required, this vacuum can be stored and used when needed for vacuum application to shift the partition.

The suction system of the internal combustion engine can be connected with a selector valve for activation of the vacuum tank, via a control line. This variant for activation of the vacuum tank represents a particularly cost-effective solution. While this embodiment does not require electrical components for valve activation, they may be used if, for example, electronic engine control is present.

If the vacuum produced by the suction system and the vacuum tank is not sufficient, or if there is no vacuum present in the suction system, the evacuation device can include a line selectively closeable by a valve connecting the equalization space with a suction pump. Preferably, the suction pump is electrically driven, although mechanical or magnetic drives are also possible.

The valve can be provided with a vent opening, which connects only the equalization space with the atmosphere when the valve is not activated. This structure advantageously provides a reduction in the cooling system volume through the vent opening of the valve, in particularly simple manner.

A power drive can be assigned to the valve. If the power drive is connected with a control unit to conduct signals, it is advantageous if the precise data of a control unit are used to control the power drive. The control unit can be activated via a characteristic field, or may be integrated into an existing electronic engine control. This makes possible particularly precise and simple activation of the valve.

It is advantageous for the equalization container to have a compensation volume which is 0.1 to 5 times as great as the steam-filled zone of the cooling system. The size of the equalization container is determined by the degree of air-steam demixing in the cooling system. In the most advantageous case, that of complete air-steam demixing, the volume of the equalization container should be sized in such a way that it can hold the entire air mass contained in the cooling system, if possible. In case of incomplete air-steam demixing, i.e., where air remains in the cooling system and an air-steam mixture gets into the cooling container, the container should be designed to be as large as possible.

DETAILED DESCRIPTION

Figure 1:
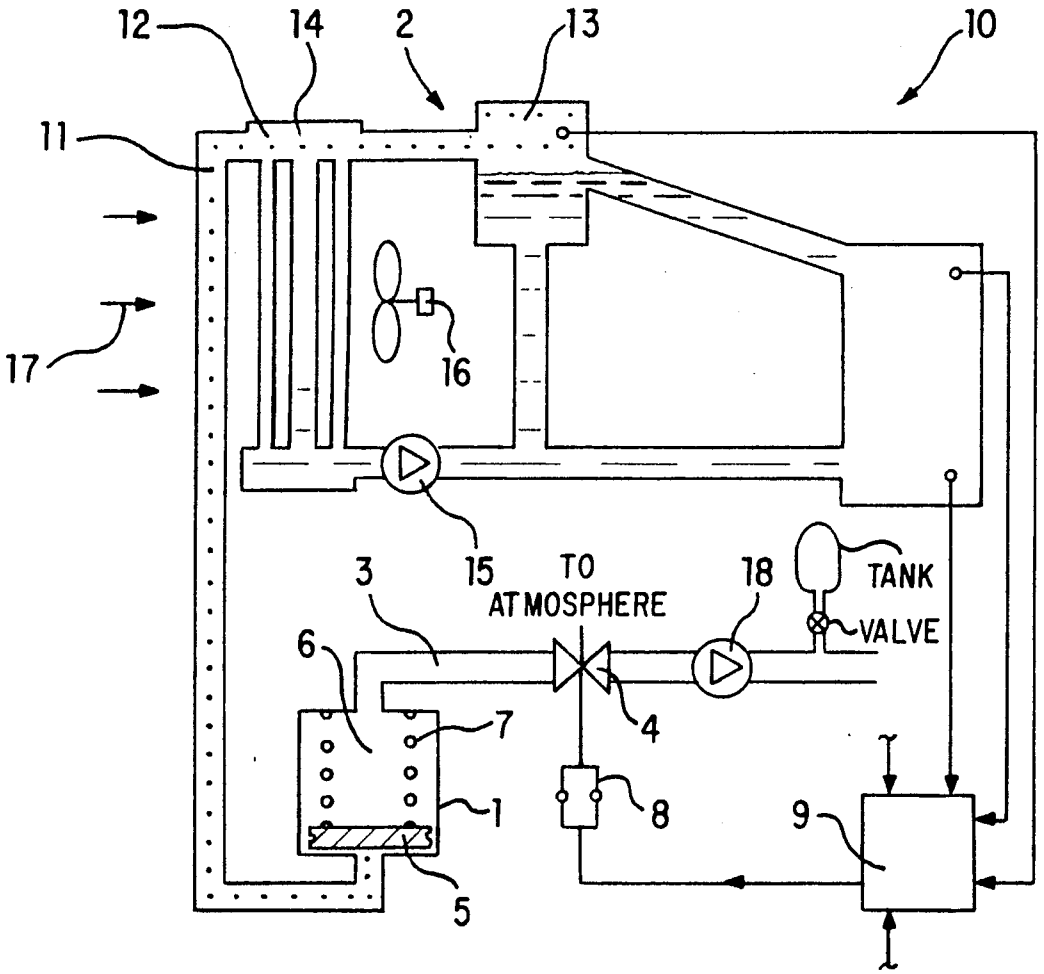
FIG. 1 shows an evaporation cooled internal combustion engine in schematic representation built according to the principles of the invention.

FIG. 1 shows an evaporation-cooled internal combustion engine 10. The engine is provided with a cooling system 2 which includes a coolant separator 13, a condenser 14, an equalization container 1, a condensate pump 15, and a control unit 9.

The coolant used can be water with an anti-freeze component. A coolant with aziotropic properties, i.e a coolant in which no demixing of the components occurs during evaporation, is preferred. The equalization container 1 is connected with an upper, steam-filled zone 12 of the cooling system 2, e.g., with the highest part of the condenser 14. Preferably, the condenser 14 is arranged in such a way that outside air 17 can readily flow through the cooling elements of the condenser. To enhance condensation, particularly at low driving speeds, a fan 16 can be provided to blow cooling air through the cooling elements of the condenser 14.

Figure 2:
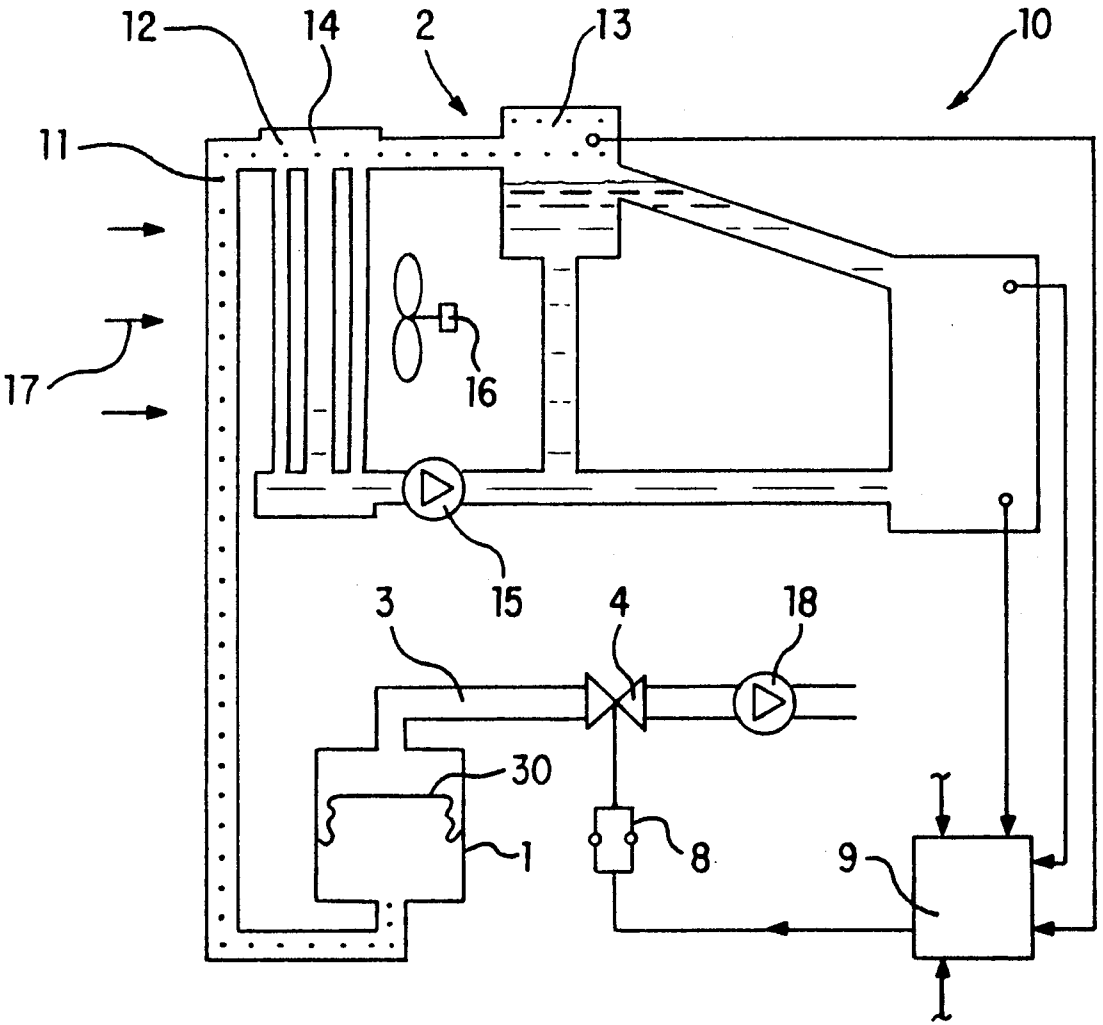
FIG. 2 shows an additional embodiment of the device of FIG. 1 in which an elastic membrane is used.
Figure 3:
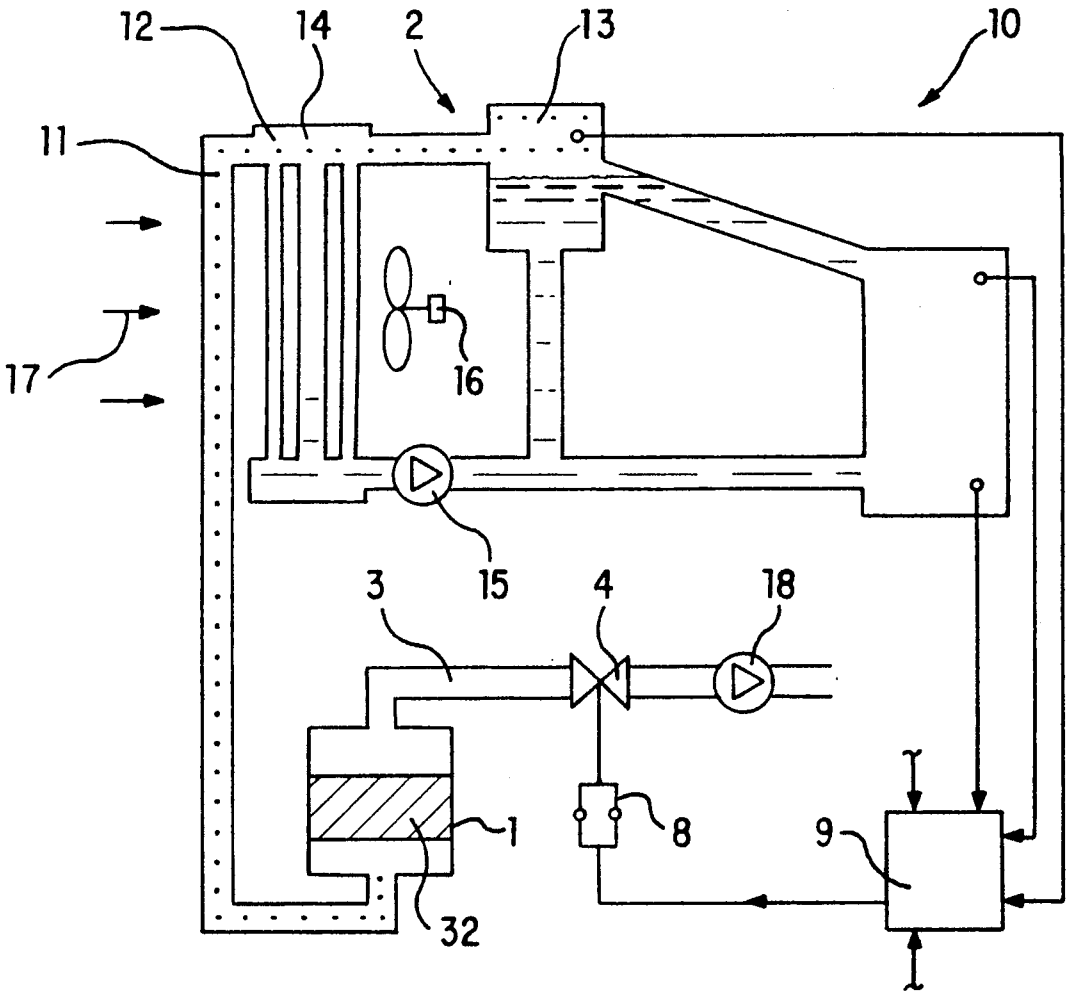
FIG. 3 shows an additional embodiment in which a pressure spring is employed.

The equalization container 1 is connected with the suction pipe of the internal combustion engine 10 or with another evacuation device, for example a pump 18, by means of a line 3, in which a valve 4 to control the stroke position of the piston 5 in the equalization container 1 is located. (In the embodiment shown in FIG. 2, an elastic membrane 30 is used instead of a piston. In the embodiment shown in FIG. 3, a pressure spring 32, which may, for example, be made of a foam material, is shown.) The valve 4 can be activated in a variety of ways, including by means of a power drive 8 which is controlled by the control unit 9. The control unit 9, which can be identical with the engine control, is connected to sensors, in signal-conducting manner, which transmit values concerning the system pressure of the cooling system 2, the coolant temperature and the engine component temperature to the control unit and thence to the power drive unit 8.

Data concerning additional parameters, such as the piston path of the piston 5, the amount of vacuum in the suction pipe, the motor rpm's, the ambient temperature and the vehicle speed can also be used to control the valve 4.

In the equalization space 6, there is a spring 7, which is assigned to the piston 5. The total volume of the cooling system 2 is changed by movement of the piston 5. In evaporation cooling, the boiling temperature adjusts according to the system pressure. A low system pressure, which is dependent on the current engine heat output, the condenser output, and the gas-steam volume in the cooling system 2, results in a lower boiling temperature and engine component temperature. A higher system pressure, in contrast, results in a higher boiling temperature and engine component temperature. As long as the coolant temperature is below the boiling temperature of the coolant, there is no evaporation with subsequent condensation.

If the internal combustion engine 10 is running under full load, for example, and the engine heat output increases greatly, the valve 4 in the line 3 leading to the evacuation device is opened, either without steps or in a cycle, and the piston 5 moves upward in the equalization container 1 against the resistance of the spring 7. If the piston 5 is at the top stop of the equalization container 1, the volume of the cooling system 2 is at its greatest, thereby minimizing the system pressure and the boiling temperature of the coolant. As long as the current coolant temperature is not below the coolant boiling temperature, the coolant evaporates and the internal combustion engine 10 is cooled; overheating of the evaporation-cooled internal combustion engine 10 is precluded. In partial-load operation of the internal combustion engine 10, the system pressure and thus the boiling temperature of the coolant are adjusted to a value advantageous for an optimum component temperature, via the piston 5.

What is claimed is:

1. An evaporation-cooling system for an internal combustion engine, comprising:

a conduit for transferring coolant to and from an internal combustion engine;

a heat exchanger operatively connected to the engine by means of the conduit, said heat exchanger having a steam-zone for the accommodation of vaporous coolant;

an equalization container linked to the steam-zone of the heat exchanger by a connection line, said equalization container containing first and second gaseous regions of variable volume, the first of which is in pneumatic communication with the heat exchanger; and control means for selectively modifying the pressure within the second gaseous region of the equalization container.

2. An evaporation-cooling system for an internal combustion engine, comprising:

a conduit for transferring coolant to and from an internal combustion engine;

a heat exchanger operatively connected to the engine by means of the conduit, said heat exchanger having a steam-zone for the accommodation of vaporous coolant;

an equalization container linked to the steam-zone of the heat exchanger by a connection line, said equalization container containing first and second gaseous regions of variable volume, the first of which is in pneumatic communication with the heat exchanger; and means for modifying the pressure within the second gaseous region of the equalization container, wherein the means for modifying the pressure within the second gaseous region include a relatively mobile and gas-tight partition arranged in the equalization container, which separates a space containing evaporated coolant from a second, equalization space, and wherein the equalization space is provided with an evacuation device which can be signal-activated.

3. The device according to claim 2, wherein the partition comprises a piston.

4. The device according to claim 2, wherein the partition comprises an elastic membrane.

5. The device according to claim 2, wherein the partition is supported on a pressure spring arranged in the equalization space.

6. The device according to claim 2, wherein the evacuation device comprises:

a line for connecting the equalization space with the suction system of an internal combustion engine; and at least one valve for selectively opening and closing said line.

7. The device according to claim 6, wherein the valve is actuated by a power drive.

8. The device according to claim 2, wherein the equalization container defines a compensation volume which is 0.1 to 5 times as great as the steam-zone of the cooling system.

9. The device according to claim 2, wherein the evacuation device further includes a line connecting the equalization space with a suction pump; and a valve in communication with the line for selectively closing off the line.

10. The device according to claim 9, wherein the valve is provided with a vent opening that connects the equalization space with the atmosphere when the valve is not activated.

11. The device according to claim 2, wherein the evacuation device comprises:

a line for connecting the equalization space with the suction system of an internal combustion engine, a vacuum tank, said vacuum tank being operatively connected to the line.

12. The device according to claim 11, wherein there is provided a selector valve for the selective communication of the vacuum tank with the equalization space via a control line.

* * * * *